US005329798A

United States Patent [19]

Takakura et al.

[11] Patent Number: 5,329,798

[45] Date of Patent: Jul. 19, 1994

[54] LEVELING DEVICE AND LEVELING METHOD

[75] Inventors: Yoshio Takakura; Tomoaki Kimura; Tadashi Nishino, all of Hitachi, Japan

[73] Assignee: Hitachi, Ltd., Tokyo, Japan

[21] Appl. No.: 825,840

[22] Filed: Dec. 23, 1991

Related U.S. Application Data

[63] Continuation of Ser. No. 583,220, Sep. 17, 1990, abandoned.

[30] Foreign Application Priority Data

Sep. 18, 1989 [JP] Japan ..... 1-240018

[51] Int. Cl.[5] ..... B21D 1/05

[52] U.S. Cl. ..... 72/164; 72/205

[58] Field of Search ..... 72/160, 205, 162, 164

[56] References Cited

U.S. PATENT DOCUMENTS

| | | | |
|---|---|---|---|
| 2,854,056 | 9/1958 | Stanius | 72/160 |
| 3,401,546 | 9/1968 | Greenberger | 72/205 |
| 3,429,164 | 2/1969 | Oganowski | 72/205 |
| 3,838,888 | 10/1974 | Greenberger | 72/205 |
| 4,134,283 | 1/1979 | Noe | 72/205 |
| 4,651,549 | 3/1987 | Masui | 72/205 |
| 4,898,013 | 2/1990 | Mazodier | 72/205 |

FOREIGN PATENT DOCUMENTS

| | | | |
|---|---|---|---|
| 56-128623 | 10/1981 | Japan . | |
| 58-151918 | 9/1983 | Japan . | |
| 63-149015 | 12/1988 | Japan . | |
| 189790 | 12/1966 | U.S.S.R. | 72/160 |

*Primary Examiner*—Daniel C. Crane

*Attorney, Agent, or Firm*—Evenson, McKeown, Edwards & Lenahan

[57] ABSTRACT

A leveling device for correcting defective shape of a strip by repeatedly bending the strip under a tensioned condition of the strip, comprising a tension leveler including a stretching roll unit for correcting local elongations of the strip and a C-warp correcting roll unit for correcting the warp in the crosswise direction of the strip, and at least a tension fluctuation suppressing means for suppressing the tension fluctuation transferred from the bridle rolls and preventing the generation of charter mark. The tension fluctuation suppressing means may be composed of a rotary resistant body of at least two deflector rolls or of a pair of pinch rolls arranged one above the other.

26 Claims, 4 Drawing Sheets

POINT ④ MOVES TO POINT ④′ OR POINT ④″ UNDER THE INFLUENCE OF EVEN SLIGHT TENSION CHANGE (→LOCAL BENDING OF ΔK OCCURS)

LEVELING DEVICE AND LEVELING METHOD

This is a continuation of application Ser. No. 07/583,220, filed Sep. 17, 1990, now abandoned.

BACKGROUND OF THE INVENTION

The present invention relates to a leveling device, and in particular, to a leveling device for correcting defective shapes of a strip and to a leveling method therefor.

A conventional leveling device is shown in Fig. 1 of Japanese Patent Unexamined Publication No. 63-149015. As shown there, the leveling device is mainly composed of a tension leveler, inlet side bridle rolls located at the inlet side of the tension leveler, and outlet side bridle rolls located at the outlet side of the same. A strip is leveled by repeatedly receiving bending actions as being tensioned by means of the inlet side and outlet side bridle rolls.

In the above-mentioned leveling device, however, chatter marks are apt to be generated on the surface of the strip, thereby deteriorating the quality of the products. Especially, this phenomenon is undesirable in the present time where the requirement for flatness is strict. Here, the term "chatter mark" is used for expressing a striped pattern extending in the crosswise direction of the strip with a small pitch on the strip surface, which has, when viewed in detail, a wave-like shape having small wave heights.

A conventional means for preventing the generation of chatter marks is disclosed in Japanese Patent Unexamined Publication No. 58-151918, where a roll unit is composed of small-diametral rolls and large-diametral rolls located at the front and rear sides of the small-diametral rolls with the strip interposed between the small-diametral rolls and the large-diametral rolls, and a plurality of these roll units are arranged on a line.

In the above-mentioned conventional art, since the winding angle of the small-diametral rolls is excessive, curvature fluctuation of the strip is generated due to the vibration of the strip, thereby generating the chatter marks. As a solution for suppressing the curvature fluctuation, the above-mentioned roll arrangement has been developed.

In the above-mentioned prior art, however, no consideration is paid to the fact that the chatter marks can be prevented by decreasing the passing speed of the strip to a very low level, for example, as low as 10 m/min.

In consequence, the generation of chatter marks can not be prevented by merely arranging great-diametral rolls in the front and rear sides of the small-diametral rolls, especially, in case the flatness requirement for the strip is strict.

On the other hand, Japanese Patent Unexamined Publication No. 56-128623 discloses an arrangement where a tension distribution control device movable in the crosswise direction of the plate, is provided between an inlet side bridle roll or an outlet side bridle roll and a tension leveler.

For obtaining an excellent shape control of the strip, the elongation of the strip in the crosswise direction is controlled by applying a suitable tension distribution to the strip in the same direction.

In the above-mentioned prior art, however, nothing is referred to with respect to the prevention of chatter marks. Further, it is clear that the chatter marks can not be prevented by merely providing the above-mentioned tension distribution control device, for the reason below.

Namely, in this tension distribution control device, since the tension distribution is applied along the widthwise direction of the strip, the influence of the tension distribution control device on the strip along the widthwise direction varies in the widthwise directions, and accordingly, the chatter marks can not be prevented.

Further, as shown in Fig. 6 of the above-mentioned Japanese Patent Unexamined Publication No. 56-128623, since the roll has a tapered portion, it is clear that the influence varies in the widthwise direction of the strip.

In addition, this tension distribution control device can be applied only to case the strip is formed with rims along the side edges of the strip, and can not be applied to a usual case.

SUMMARY OF THE INVENTION

The object of the present invention is to provide a leveling device which can prevent the generation of chatter marks in a wide range of the strip passing speed from a low speed to a high speed for assuring the quality of the product, and can satisfy the strict requirement for flatness of the strip.

The present invention has been resulted from the earnest study with respect to the real reason for the generation of chatter marks.

For achieving the above-mentioned object, in the leveling device according to the present invention, there are provided, between the tension leveler and one of the inlet side and outlet side bridle rolls or between the tension leveler and each of the inlet and outlet side bridle rolls, tension fluctuation absorbing means for absorbing the tension fluctuation from the bridle rolls, a rotary resistant body for cutting out the tension fluctuation from the bridle rolls, deflector rolls, or pinch rolls; or one of the above-mentioned tension fluctuation absorbing means, rotary resistant body, deflector rolls, or pinch rolls is arranged at the inlet side of the stretching roll unit of the tension leveler for correcting local elongations of the strip; or further, the deflector rolls and the pinch rolls are covered with elastic material on their surfaces.

DETAILED DESCRIPTION OF PREFERRED EMBODIMENTS

The present invention has resulted from studies of the real reason for the generation of chatter marks.

The results of studies of the real reason for the generation of chatter marks will be described below. Chatter marks are generated for the reason that the strip is sharply bended by the small-diametral roll portion of the tension leveler and reformed back again, thereby generating very unstable energy in the strip, which makes the curvature easily fluctuate under the influence of a slight tension change and generates chatter mark. This phenomenon is explained below by referring to FIG. 6 to FIG. 8.

Figure 6:
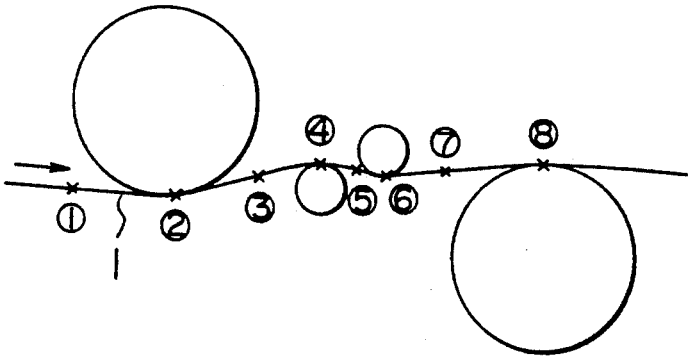
FIG. 6 is a partial illustration for explaining the reason for the generation of charter mark.
Figure 7:
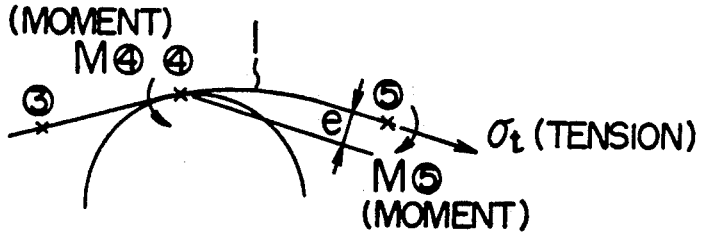
FIG. 7 is a partial detailed view of FIG. 6, and FIG. 8 sows characteristic curve indicating a bending action history of the strip relating to curvature and bending moment when the strip passes through the tension leveler.
Figure 8:
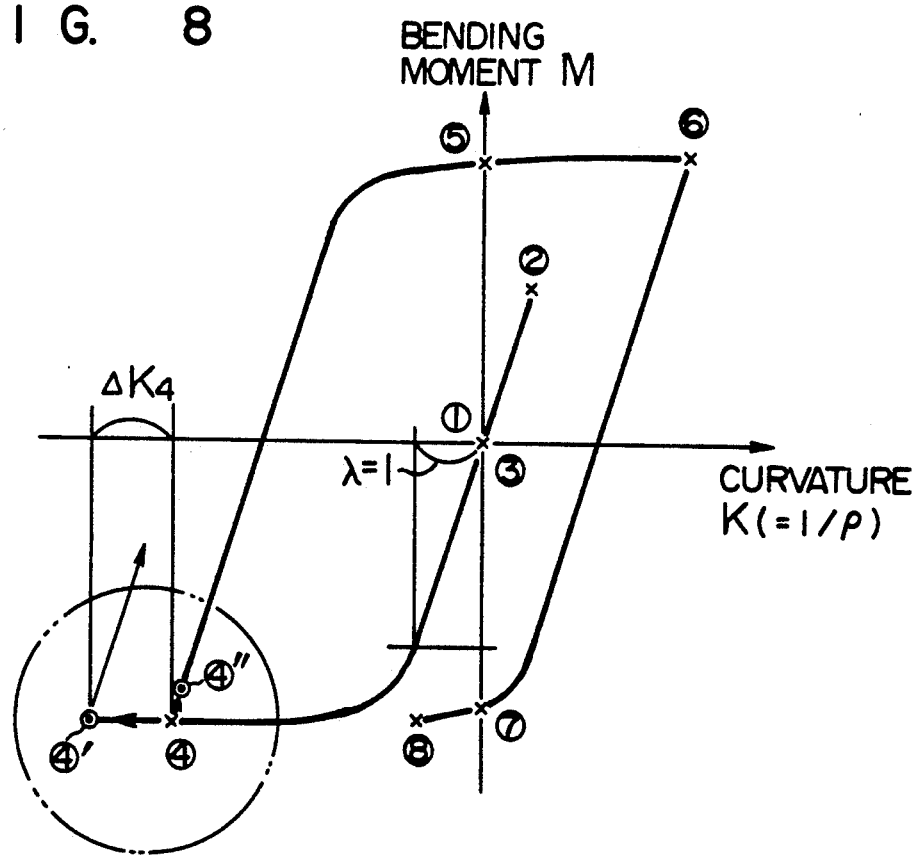

In general, when a strip (plate) passes through rolls #1, #2, #3 and #4 as shown in FIG. 6, the strip is subjected to a bending history relating to curvature and bending moment as shown in FIG. 8. The numerals ①, ②, - - - ⑧ in FIGS. 6 and 7 correspond to the numerals ①, ②, - - - ⑧ in FIG. 8. At the position where the strip contacts with the small-diametral roll #2, the strip 1 is sharply bent with a bending moment of nearly saturated state, and the curvature of the strip considerably changes under the influence of even a small change of the bending moment. What causes the change of the bending moment is a tension fluctuation. When the strip passes over the smaller roll #2, the strip 1 is bent as shown in FIG. 7, and the bending moment at the point ④ is expressed as a product of the tension $\sigma_t$ by the moment arm e. Due to the existence of the moment arm e, a slight tension fluctuation causes a considerable change of the bending moment at the point ④. Further, since the bending moment at the point ④ is in a saturated state, a sharp curvature change $\Delta k_4$ is produced. This curvature change $\Delta k_4$ is very great, and therefore, this local bending can not be corrected even if the strip is passed through the following rolls, and chatter marks are generated. From our calculation and experiments, it has been proved that a tension fluctuation of as small as 0.01–0.03 kg/mm causes the generation of chatter marks.

In consequence, it become clear that, in order to prevent the generation of chatter marks, the suppressing of the tension fluctuation at a very low level is required. As to the causes of generating the tension fluctuation, there are considered several ones such as vibration of the bridle roll frame disposed at the front and rear sides of the tension leveler, inaccurate cylindrical shape of the various rolls, eccentricity of the cylindrical portions, rotation speed fluctuation of the bridle rolls due to inaccurate shape of gears for driving these rolls, and so on. Even when these causes are suppressed as low as possible, it has been impossible to completely suppress the chatter marks, because the allowable range of the tension fluctuation amount is very narrow as described above.

Therefore, for completely preventing the generation of chatter marks, it is required to absorb these slight tension fluctuations. The present inventor has paid attention that this tension fluctuation has a high frequency higher than 40 Hz, and the amplitude of the fluctuation is very small.

In the concrete, there are provided, between the tension leveler and one of the inlet side and outlet side bridle rolls or between the tension leveler and each of the inlet and outlet side bridle rolls, tension fluctuation absorbing means for absorbing the tension fluctuation from the bridle rolls, a rotary resistant body for cutting out the tension fluctuation from the bridle rolls, deflector rolls, or pinch rolls; or one of the above-mentioned tension fluctuation absorbing means, rotary resistant body, deflector rolls, or pinch rolls is arranged at the inlet side of the stretching roll unit of the tension leveler for correcting local elongations of the strip; or further, the deflector rolls and the pinch rolls are covered with elastic material on their surfaces.

Next, referring to FIGS. 1 to 5, an embodiment of the present invention will be described below.

Figure 1:
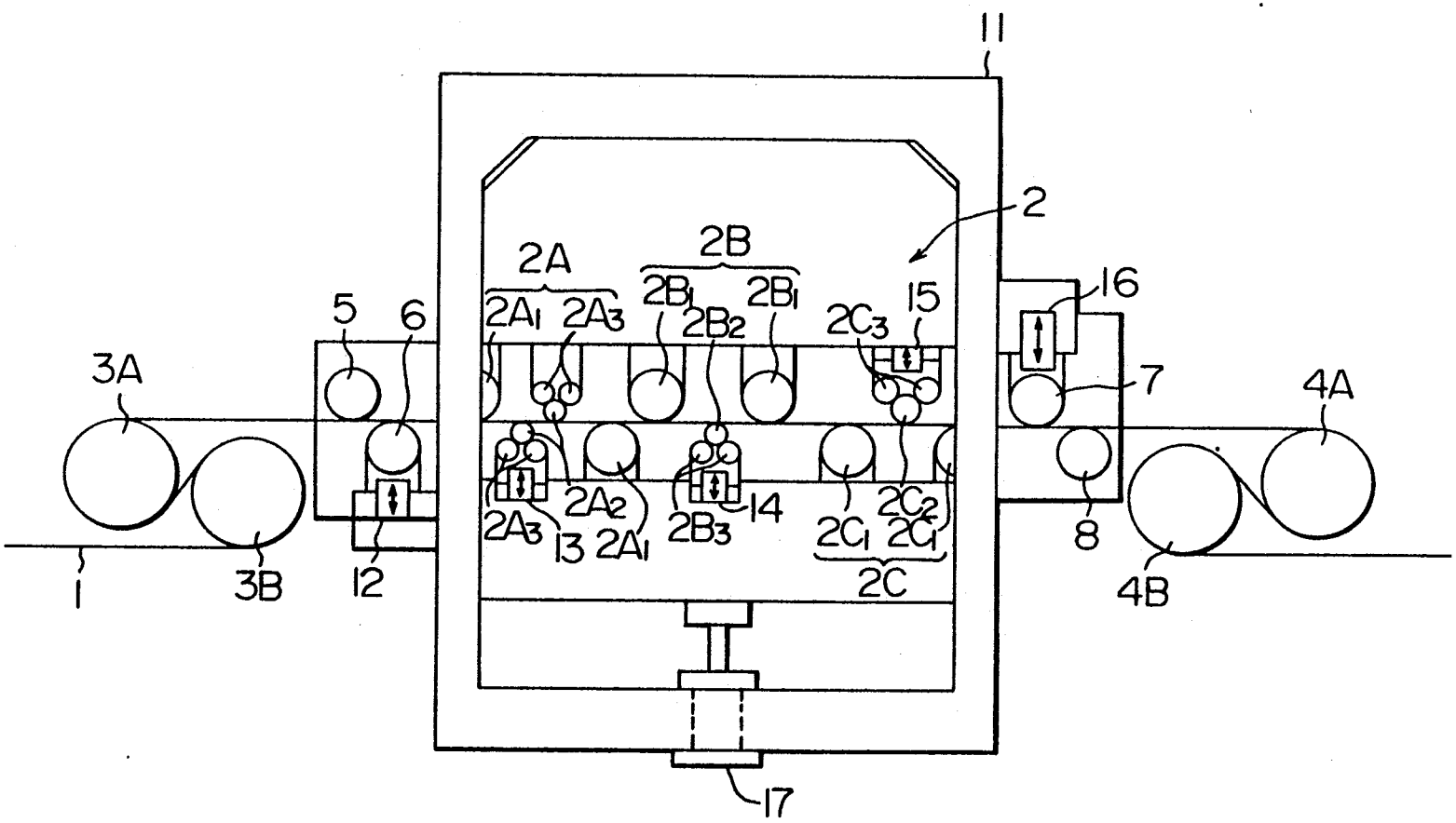
FIG. 1 is an illustration showing a concrete structure of leveling device according to an embodiment of the present invention.
Figure 2:
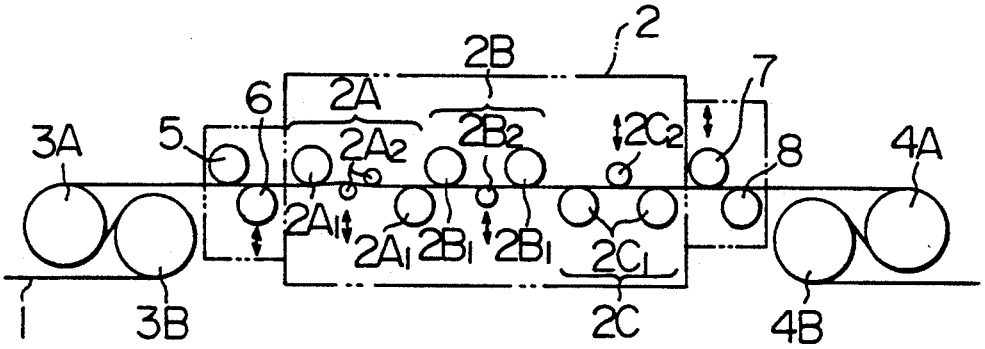
FIG. 2 is a schematic illustration of the leveling device shown in FIG. 1, FIG. 3 to FIG. 5 are schematic illustrations of leveling device according to the other embodiments of the present invention.

In FIGS. 1 and 2, numeral 2 denotes a tension leveler, which is supported by a housing 11 and composed of a stretching roll unit 2A including large-diametral rolls 2A, disposed above and below with a strip 1 interposed therebetween and small-diametral rolls $2A_2$ disposed above and below and between the upper and lower large-diametral rolls $2A_1$ for correcting local elongations of the strip 1, a C (widthwise)-warp correcting roll unit 2B including two large-diametral rolls $2B_1$ disposed at upper positions and one small-diametral roll 2B2 disposed below the strip 1 and between the large-diametral rolls $2B_1$ for correcting the crosswise warps of the strip 1, and a L (lengthwise)-warp correcting roll unit 2C including two large-diametral rolls $2C_1$ disposed below the strip 1 and one small-diametral roll $2C_2$ disposed above the strip 1 and between the large-diametral rolls $2C_1$ for correcting the lengthwise warps of the strip 1. At the inlet side of the tension leveler 2 there are arranged two bridle rolls 3A, 3B, and at the outlet side there are arranged two bridle rolls 4A, 4B. In this embodiment, between the inlet side bridle rolls 3A, 3B and the stretching roll unit 2A of the tension leveler 2 and between the outlet side bridle rolls 4A, 4B and the L-warp correcting roll unit 2C of the tension leveler 2, there are arranged a pair of deflector-rolls 5, 6 disposed above and below and a pair of deflector-rolls 7, 8 constructed in the same manner, respectively. These deflector-rolls serves as a means for absorbing a tension fluctuation from the bridle rolls or as a rotary resistant body for cutting out the tension fluctuation.

The inlet side deflector-roll 6 and the outlet side deflector-roll 7 are constructed to be movable in the vertical direction by means of cylinder devices 12 and 16, respectively.

Each of the small-diametral rolls $2A_2$ of the stretching roll unit 2A is supported by two back-up rolls $2A_3$, and the small-diametral roll $2A_2$ locating nearer to the inlet side is constructed to be movable in the vertical direction by means of a cylinder device 13.

Further, the small-diametral rolls $2B_2$ of the C-warp correcting roll unit 2B and the small-diametral rolls $2C_2$ of the L-warp correcting roll unit 2C are supported by the two back-up rolls $2B_3$ and two back-up rolls $2C_3$, respectively, and can be moved in the vertical direction by cylinder devices 14 and 15, respectively.

Further, the group of the lower rolls locating below the strip 1 is constructed to be movable in the vertical direction by means of a cylinder device 17.

Now, the function of the tension leveler will be described.

The strip 1 is passed through the inlet side bridle rolls 3A, 3B and then through the deflector rolls 5, 6 to the tension leveler 2. In the tension leveler 2, the strip 1 is repeatedly subjected to bending actions from the plural rolls of the stretching roll unit 2A, C-warp correcting roll unit 2B, and L-warp correcting roll unit 2C, thereby correcting the shape of the strip. Then, the strip 1 is passed through the outlet side deflector rolls 7, 8 and the outlet side bridle rolls 4A, 4B to an outlet side apparatus. As described above, since the strip 1 is strongly bent by the small-diametral rolls in the tension leveler 2, curvature fluctuations of the strip 1 are apt to be caused even by a slight tension change in the strip, and this curvature fluctuation generates the chatter mark. In general, the rolls in the tension leveler receive no driving force and each has a high precision in shape, and accordingly, the tension fluctuation in this region is extremely small so as to generate no chatter mark. On the other hand, the inlet and outlet sides bridle rolls 3A, 3B and 4A, 4B are driven by various gear systems, and accordingly, the fluctuations in rotation of the bridle rolls are apt to be generated due to unavoidable errors in tooth profile, thereby causing tension fluctuations of the strip and generating chatter mark. Considering this mechanism of generating chatter mark, in this embodiment, at the front and at the rear of the tension leveler 2 are provided deflector rolls 5, 6 and 7, 8, respectively, for cutting out or absorbing the tension fluctuation from the bridle rolls, and preventing the tension fluctuation from being transmitted to the tension leveler 2. The experiment has proved that the generation of the chatter marks can be completely prevented by virtue of the above-mentioned arrangement.

The principle of the function of the deflector rolls 5, 6 or 7, 8 for cutting out or absorbing the tension fluctuation is described below.

Due to the bending stiffness of the strip, some slack of the strip appears at the deflector roll portion. When the tension fluctuation reaches this portion, the amount of the slack of the strip changes, thereby absorbing the tension fluctuation and significantly decreasing the tension fluctuation to be transferred to the next step. As a result, the generation of chatter marks can be prevented.

Further, the deflector rolls are driven by the strip, and accordingly, when a tension change (identical with speed change) of the strip happens, a rotation speed change of the deflector rolls in such a direction as to suppress the tension change is produced (inertia effect), thereby absorbing the tension fluctuation. As a result, the generation of chatter marks is prevented.

Next, referring to FIG. 3, another embodiment of the present invention is described below.

Figure 3:
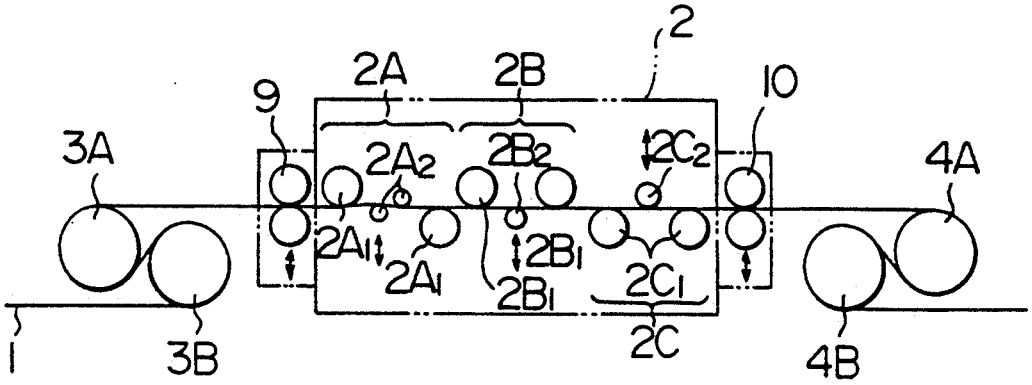

In the embodiment shown in FIG. 3, in order to cutout or absorb the tension fluctuation, instead of the above-mentioned deflector rolls, there are provided a pair of pinch rolls 9 disposed one above the other at the inlet side of the tension leveler 2 and a pair of pinch rolls 10 at the outlet side of the same. The pinch rolls 9 and 10 pinch the strip 1 therebetween, and cutout or absorb the tension fluctuation with the same effect as in the before-mentioned embodiment.

The principle of the tension absorbing function of the pinch rolls will be described below.

There is no slip between the pinch rolls and the strip due to the pressing force of the pinch rolls.

Any tension fluctuation or speed fluctuation of the strip from the bridle rolls causes the speed fluctuation of the pinch rolls. Thus, such a tension fluctuation is absorbed by the pinch rolls (inertia effect), and is not transferred to the strip portion downstream of the pinch rolls.

As the pressing force of the pinch rolls increases, and as the diameter of the rolls increases, so the tension fluctuation absorbing effect increases.

Further, in the above-mentioned embodiments, it may be also possible to cover the surfaces of the deflector rolls or the pinch rolls with elastic material, to construct each of the rolls so as to be moved by a downward pressing force, or to drive the roll or rolls for rotation. Each of these arrangements or a combination thereof can, of course, obtain the same effect as mentioned below.

Figure 4:
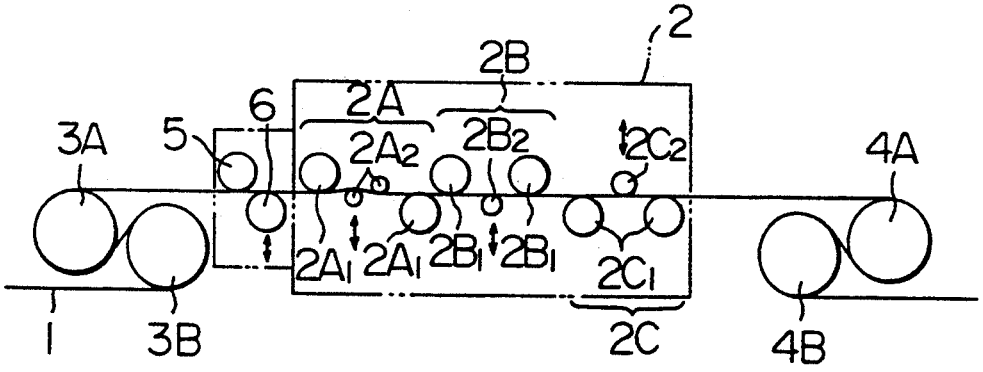
Figure 5:
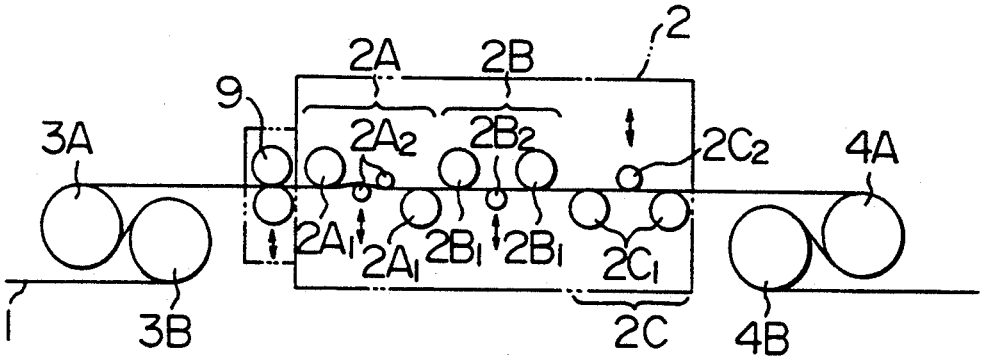

In general, in the tension leveler, each of the outlet side rolls has a greater diameter and a smaller downward pressing force in comparison with those of the inlet side stretching rolls for the purpose of warp correction, and accordingly, the bending force here is not so strong as at the stretching roll portion. In consequence, the chatter marks are rarely generated at the outlet side portion, and accordingly, the generation of the chatter marks is rarely caused by the tension fluctuation of the outlet bridle rolls. As a result, as shown in FIGS. 4 and 5, the outlet side deflector rolls 7, 8 or the outlet side pinch rolls 10 can be omitted. In other words, the tension fluctuation of the strip is mainly caused by the inlet side bridle rolls, and therefore, the generation of the chatter mark can be sufficiently prevented by providing deflector rolls 5, 6 or pinch rolls 9 only at the inlet side of the tension leveler, because the above-mentioned main tension fluctuation can be absorbed by these rolls.

The above-mentioned theory is suitably applied especially to a thick strip, which has a great bending stiffness and in which the generation of chatter marks is difficult.

In the leveling device according to the present invention, there are provided, between the tension leveler and one of the inlet side and outlet sides bridle rolls or between the tension leveler and each of the inlet and outlet sides bridle rolls, a tension fluctuation absorbing means for absorbing the tension fluctuation from the bridle rolls, a rotary resistant body for cutting out the tension fluctuation from the bridle rolls, deflector rolls, or pinch rolls; or one of the above-mentioned tension fluctuation absorbing means, rotary resistant body, deflector rolls, or pinch rolls is arranged at the inlet side of the stretching roll unit of the tension leveler for correcting local elongations of the strip; or further, the deflector rolls and the pinch rolls are covered with elastic material on their surfaces. Thus, since the tension fluctuation from the bridle rolls disposed in the front and in the rear of the tension leveler is absorbed by these tension fluctuation absorbing means, rotary resistant body, deflector rolls, or pinch rolls, the generation of the chatter mark can be prevented even in case the strip speed is low. As a result, there is obtained a product having no deteriorated quality and being able to satisfy the strict requirement for flatness of the strip.

What is claimed is:

1. A levelling device for a strip including a tension leveler and bridle rolls arranged at the inlet side and at the outlet side of said tension leveler, said inlet side and outlet side bridle rolls applying a tension to said strip, and a roll group in said tension leveler applying bending actions and stretching actions to said strip for correcting the flatness of said strip, comprising:

a tension fluctuation suppressing means provided at least between said inlet side bridle rolls and said tension leveler for substantially suppressing tension fluctuations transferred from said bridle rolls through said strip to said tension leveler, wherein said tension fluctuation suppressing means includes first and second fluctuation suppressing rolls between which said strip travels and pressing means for adjustably moving said first fluctuation suppressing roll toward the second fluctuation suppressing roll to thereby suppress tension fluctuations transferred from said bridle rolls through said strip to said tension leveler.

2. A leveling device claimed in claim 1, comprising a further tension fluctuation suppressing means provided between said outlet side bridle rolls and said tension leveler for suppressing tension fluctuations caused by said outlet side bridle rolls and transferred through said strip, wherein said further tension fluctuation suppressing means includes third and fourth fluctuation suppressing rolls between which said strip travels and further pressing means for adjustably moving said third fluctuation suppressing roll toward the fourth fluctuation suppressing roll to thereby suppress tension fluctuations caused by said outlet side bridle rolls and transferred through said strip.

3. A leveling device according to claim 1, wherein said first and second fluctuation suppressing rolls are deflector rolls arranged offset with respect to one another in the lengthwise direction of the strip.

4. A leveling device according to claim 1, wherein said first and second fluctuation suppressing rolls are pinch rolls arranged one above the other.

5. A leveling device according to claim 2, wherein said third and fourth fluctuation suppressing rolls are deflector rolls arranged offset with respect to one another in the lengthwise direction of the strip.

6. A leveling device according to claim 2, wherein said third and fourth fluctuation suppressing rolls are pinch rolls arranged one above the other.

7. A leveling device according to claim 1, wherein said first and second fluctuation suppressing rolls are covered with an elastic material on the surfaces thereof.

8. A leveling device according to claim 2, wherein said third and fourth fluctuation suppressing rolls are covered with an elastic material on the surface thereof.

9. A leveling device according to claim 1, wherein one of said first and second fluctuation suppressing rolls is so constructed as to be downwardly movable by a further pressing force.

10. A leveling device according to claim 2, wherein one of said second and third fluctuation suppressing rolls is so constructed as to be downwardly movable by a further pressing force.

11. A leveling device according to claim 1, wherein at least one of said first and second fluctuation suppressing rolls is constructed to be rotationally driven.

12. A leveling device according to claim 2, wherein at least one of said third and fourth fluctuation suppressing rolls is constructed to be rotationally driven.

13. A levelling device for a strip comprising a tension leveler composed of a stretching roll unit for correcting local elongations of said strip, a C-warp correcting roll unit for correcting warps in the crosswise direction of said strip, and a L-warp correcting roll unit for correcting warps in the lengthwise direction of said strip, and bridle rolls arranged at the inlet side and at the outlet side of said tension leveler, said inlet side and outlet side bridle rolls being adapted to exert tension to the strip, said roll group of said tension leveler being operated for correcting the flatness of the strip under the tensioned condition of the strip, comprising:

a tension fluctuation suppressing means provided at least at the inlet side of said stretching roll unit of said tension leveler for substantially suppressing tension fluctuations transferred from said inlet side bridle rolls through said strip to said tension leveler, wherein said tension fluctuation suppressing means includes first and second fluctuation suppressing rolls between which said strip travels and pressing means for adjustably moving said first fluctuation suppressing roll toward the second fluctuation suppressing roll to thereby suppress tension fluctuations transferred from said bridle rolls through said strip to said tension leveler.

14. A leveling device according to claim 13, wherein said first and second fluctuation suppressing rolls are deflector rolls arranged offset with respect to one another in the lengthwise direction of the strip.

15. A levelling device according to claim 13, wherein said first and second fluctuation suppressing rolls are pinch rolls arranged one above the other.

16. A levelling device according to claim 14, wherein said deflector rolls are covered with an elastic material on the surface thereof.

17. A levelling device according to claim 15, wherein said pinch rolls are covered with an elastic material on the surface thereof.

18. A levelling device according to claim 13, wherein one of said first and second fluctuation suppressing rolls is so constructed as to be downwardly movable by a further pressing force.

19. A leveling method for a strip including steps of exerting a tension to the strip by using bridle rolls, and of bending and stretching the strip under the tensioned condition of the strip by using a roll group of a tension leveler for correcting the flatness of the strip, comprising a step of restricting the strip coming from said bridle rolls, before the strip enters into said tension leveler, and guiding said strip to said tension leveler for correcting the flatness of the strip in said tension leveler, wherein said step of restricting includes passing the strip between first and second fluctuation suppressing rolls and adjustably pressing said first fluctuation suppressing roll toward the second fluctuation suppressing roll to thereby suppress tension fluctuations transferred from said bridle rolls through said strip to said tension leveler.

20. A leveling method according to claim 19, wherein said fluctuation suppressing rolls are pinch rolls arranged one above the other.

21. A leveling method for a strip including a step of exerting a tension to the strip by using bridle rolls, and a step of bending and stretching the strip under the tensioned condition of the strip by using a roll group of a tension leveler for correcting the flatness of the strip, comprising:

a step of absorbing tension fluctuations of the strip caused by said bridle rolls, by pressing the strip against a rotary resistant body before the strip enters into said tension leveler, and a step of correcting the flatness of the strip in said tension leveler, wherein said step of absorbing tension fluctuation includes passing the strip between first and second fluctuation suppressing rolls and adjustably pressing said first fluctuation suppressing roll toward the second fluctuation suppressing roll to thereby suppress tension fluctuations transferred from said bridle rolls through said strip to said tension leveler.

22. A leveling method according to claim 21, wherein said fluctuation suppressing rolls are pinch rolls arranged one above the other.

23. A leveling device, comprising:

bridle rolls for applying a tension to a strip, a tension fluctuation absorbing means for absorbing the tension fluctuation caused by said bridle rolls, and a tension leveler for correcting the flatness of the strip by applying bending actions and stretching actions to the strip by using plural rolls in the tension leveler after the tension fluctuation has been absorbed by said tension fluctuation absorbing means, wherein said tension fluctuation absorbing means includes first and second fluctuation suppressing rolls between which said strip travels and pressing means for adjustably moving said first fluctuation suppressing roll toward the second fluctuation suppressing roll to thereby suppress tension fluctuations transferred from said bridle rolls through said strip to said tension leveler.

24. A levelling device for a strip including a tension leveler and bridle rolls arranged at the inlet side and at the outlet side of said tension leveler, said inlet side and outlet side bridle rolls applying a tension to said strip, and a roll group in said tension leveler applying bending actions and stretching actions to said strip for correcting the flatness of said strip, comprising:

a tension fluctuation suppressing means provided at least between said inlet side bridle rolls and said tension leveler for substantially suppressing tension fluctuations transferred from said bridle rolls through said strip to said tension leveler;

wherein said tension fluctuation suppressing means includes first and second fluctuation suppressing rolls between which said strip travels and pressing means for adjustably moving said first fluctuation suppressing roll toward the second fluctuation suppressing roll to thereby suppress tension fluctuations transferred from said bridle rolls through said strip to said tension leveler.

25. A levelling device for a strip including a tension leveler and bridle rolls arranged at the inlet side and at the outlet side of said tension leveler, said inlet side and outlet side bridle rolls applying a tension to said strip, and a roll group in said tension leveler applying bending actions and stretching actions to said strip for correcting the flatness of said strip, comprising:

large diametrical rolls, disposed in the leveler above and below said strip;

small diametrical rolls, disposed between said large diametrical rolls;

first and second fluctuation suppression rolls between which said strip travels; and pressing means for adjustable moving said first fluctuation suppression roll toward the second fluctuation suppression to thereby suppress tension fluctuations transferred from said bridle rolls through said strip to said tension leveler.

26. A levelling method for a strip including steps of exerting a tension to the strip by using bridle rolls, and of bending and stretching the strip under the tensioned condition of the strip by using a roll group of a tension leveler for correcting the flatness of the strip, said roll group comprising large diametrical rolls disposed in the leveler above and below said strip and small diametrical rolls disposed between said large diametrical rolls, said method comprising a step of restricting the strip coming from said bridle rolls, before the strip enters into said tension leveler, and guiding said strip to said tension leveler for correcting the flatness of the strip in said tension leveler, wherein said step of restricting includes passing the strip between first and second fluctuation suppression rolls and adjustably pressing said first fluctuation suppression roll toward the second fluctuation suppression roll to thereby suppress tension fluctuations transferred from said bridle rolls through said strip to said tension leveler.

* * * * *